US007128174B2

(12) United States Patent
Carta

(10) Patent No.: US 7,128,174 B2
(45) Date of Patent: Oct. 31, 2006

(54) DRILLING AND ANCHORING DEVICE FOR DIVERSE APPLICATIONS

(76) Inventor: Ivan Carta, Av. Humberto Marshal Alencar Castello Branco, 875 Bairro Cristo Rei, Curitiba-Paraná, Cep: 82530-020 (BR)

( * ) Notice: Subject to any disclaimer, the term of this patent is extended or adjusted under 35 U.S.C. 154(b) by 22 days.

(21) Appl. No.: 10/728,988

(22) Filed: Dec. 8, 2003

(65) Prior Publication Data

US 2004/0173385 A1 Sep. 9, 2004

(30) Foreign Application Priority Data

Mar. 8, 2003 (BR) ..... 8301127 U

(51) Int. Cl.
*E21B 10/44* (2006.01)

(52) U.S. Cl. ..... 175/388; 175/394

(58) Field of Classification Search ..... 175/394, 175/388

See application file for complete search history.

(56) References Cited

U.S. PATENT DOCUMENTS

| | | | | |
|---|---|---|---|---|
| 4,061,197 | A * | 12/1977 | Skidmore, Jr. | 175/101 |
| 4,981,000 | A * | 1/1991 | Hamilton et al. | 52/157 |
| 5,167,423 | A * | 12/1992 | Hall, Jr. | 280/486 |
| 5,875,860 | A * | 3/1999 | Coelus | 175/323 |
| 5,881,978 | A * | 3/1999 | Rust | 248/156 |

* cited by examiner

*Primary Examiner*—Frank S. Tsay
(74) *Attorney, Agent, or Firm*—Jeffrey Furr

(57) ABSTRACT

The present invention describes a drilling and anchoring device for diverse application, which possess as a basic principle to provide the formation of a specific drilling and anchoring device of the most diverse products to soils, fully based on a lower penetration device in order to fully optimize both processes by directly eliminating excavations and high efforts, having as a basis a drilling and anchoring device incorporating a proprietary structure of high durability and strength possessing a properly integrated and attached main supporting body, a lower penetration device, a central rotating device and, as an option, an upper fitting device, so as to form a structure whose shape and internal and external arrangement directly adapts itself to the most diverse types of soils and products in general.

4 Claims, 2 Drawing Sheets

DRILLING AND ANCHORING DEVICE FOR DIVERSE APPLICATIONS

The present patent relates to mechanical devices in general, more specifically to a drilling and anchoring device for diverse applications which, according to the characteristics thereof, possesses as a basic principle to provide the formation of a specific device used to drill objects and anchoring them to soils, fully based on a lower penetration tip, in order to fully optimize both processes by directly eliminating excavations and high efforts, having as a basis a drilling and anchoring device with great strength, safety and versatility. With a specific design and shape, easily accessible for a better adaptation, safety for the users, practical handling, functionality, compact, accessible cost and due to its characteristics and dimensions, is easily adaptable to several types of soils, users and applications in general.

The patent in question is characterized in that it aggregates components and processes in a differentiated concept to meet the various requirements the nature of its use demands, that is, help attaching lifting rods to several types of soils. Such concept provides a device of great functionality, versatility, practicality, efficiency, strength and safety due to its excellent technical qualities, thereby providing advantages and improvements for the attachment of the most diverse products to soils; the general characteristics of which differ from the other shapes and models known in the current state of the art.

The present patent consists in the use of a modern, efficient, safe and functional drilling and anchoring device for diverse applications formed by an assembly of properly incorporated mechanic and ergonomic solutions, comprising a complete and differentiated drilling and anchoring device with exclusive design, optimum finish details and proprietary characteristics, and incorporating a proprietary structure of high durability and strength, in plastic or metallic material of high resistance or similar material and possessing a properly integrated and attached main supporting body forming the assembly main structure, a lower penetration device forming the penetration main element into the soil, a central rotating device forming the penetration auxiliary element and, as an option, an upper fitting device for the purpose of fitting and attaching the products, so as to form, through a modular structure, an extremely compact, versatile and safe drilling and anchoring device, whose shape and internal and external arrangement directly adapts itself to the most diverse types of soils and products in general, for the specific purpose of directly attaching those products to the ground without the need of a pre-excavation, as well as requiring a reduced effort and providing a greater resistance to the products' support.

The drilling and anchoring device is based on the utilization of components and processes in a differentiated concept, without, however, achieving a high degree of sophistication and complexity, making it possible to solve some of the main inconvenients of the other shapes and models known in the current state of the art and employed in the attachment of the most diverse products to soils in general, which are located in an operating range in which the handling difficulties, accidents, high costs and dimensions are frequent and whose shapes and/or products are obsolete and based on simple adaptations, as the ones locally handcrafted, which causes fragility and very low durability and resistance, or else they have a large structure, which means high costs, difficult handling and mobility and the need of high skilled labor.

Among the range of products that may be driven and attached to the ground by means of the present device, it may be cited: lampposts in general, road signs, dividing and decorative fences, border demarcation points, anchorage bearings, stays, among others; in short, everything that requires being attached to the ground, be that permanently or not, within the applicable resistance characteristics, both in a manual or mechanical way.

The objects, advantages and other important characteristics of the patent in question can be more easily understood when read jointly with the appended drawings, wherein.

Figure 1:
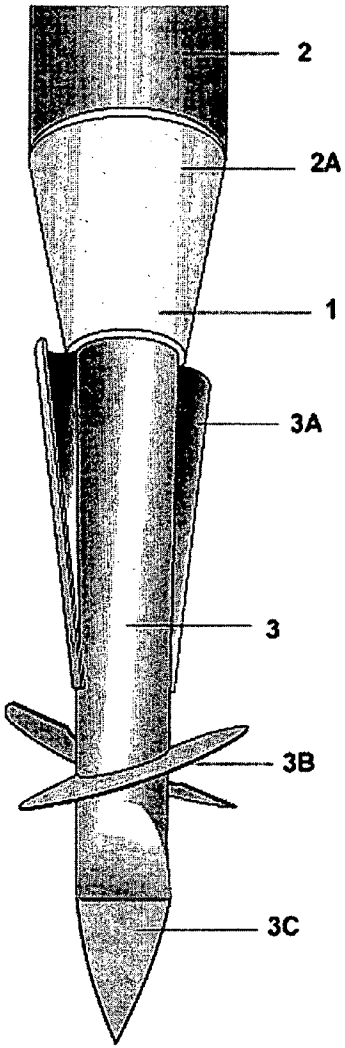
FIG. 1 is a detailed perspective view of the drilling and anchoring device for diverse applications.
Figure 2:
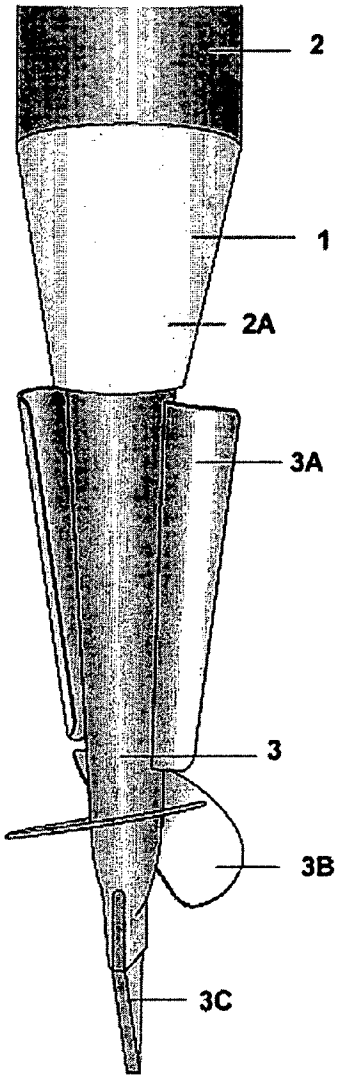
FIG. 2 is another detailed perspective view of the drilling and anchoring device for diverse applications.

As can be inferred from the appended drawings that illustrate and integrate the present descriptive report of the patent for utility model of "Drilling and Anchoring Device for Diverse Applications", pointed out in a general way in FIG. (1), the said device is comprised by a drilling and anchoring device (1) whose shape and internal and external arrangement directly adapts itself to the most diverse types of soils and products in general, and incorporating a proprietary and modular structure of high durability and strength, made of plastic or metallic material of high resistance or similar material of equal or higher lightness and strength, possessing a properly integrated and attached main supporting body (2) having a general tubular shape and a tip (2A) of cylindrical shape symmetrically arranged at the lower end as an extension, forming the assembly main structure on the soil and the support of several products from its upper end; a lower penetration device (3) having a general conical and pointed shape, symmetrically arranged and fitted from its upper end into the main supporting body (2) lower end, as a lower extension thereof, and having an upper coupling tip threaded on its external surface and centrally arranged at the upper end to attach the lower penetration device (3) to the main supporting body (2) by superposition, two plates (3A) having general trapezoidal shapes with a small concavity on their length and symmetrically and perpendicularly arranged on the outer surface of the lower penetration device (3), two blades (3B) having general semicircular shapes, symmetrically and perpendicularly arranged around part of the outer surface of the lower penetration device (3), with a slight inclination in relation to the axis and a little bit below the two plates (3A), forming a helical element, and a tip (3C) having a general pointed shape, centrally arranged and attached to the lower end as a lower extension thereof, the entire assembly as a penetrating device and for the purpose of helping and facilitating the direct penetration into the soil; and a central rotating device having a general tubular shape threaded on its lower end inner surface which, during its use, is arranged lengthwise inside the main supporting body (2) and is attached by its lower end to the upper end of the lower penetration device (3) for the purpose of rotating the latter for the penetration of the assembly as a whole.

The drilling and anchoring device for diverse applications, according to the general use needs, may comprise a drilling and anchoring device (1) incorporating a proprietary and modular structure forming the main supporting body (2) and the lower penetration device (3) by its upper and lower ends, respectively, with the lower penetration device (3) forming an extension of the main supporting body (2), and maintaining all the other characteristics.

The drilling and anchoring device for diverse applications, according to the general use needs, may comprise an upper fitting device perpendicularly arranged and fitted to the upper end of the main supporting body (2), as an extension thereof, for the purpose of fitting and attaching the most diverse products.

The operation of the drilling and anchoring device (1) is based on the proper positioning of the lower penetration device on the soil the product is to be applied. When the component is properly positioned, the lower penetration device (3) starts a rotating motion by means of the central rotating device, both rotating independently from the main supporting body (2), in a manual or mechanized way, and helped or not by an upper rotating device. As the lower penetration device (3) rotates, it is gradually drilled into the soil and, consequently, drags with itself the main supporting body (2) that, in its turn, is little by little driven into the soil. The process is completed when the main supporting body (2) is driven to an ideal attachment and stabilization depth, both of its structure and of the product attached thereof to the upper end.

The components of the drilling and anchoring device for diverse applications are fully fitted and attached, do not present any distorting or breakable parts, are highly resistant and completely safe. After fitted and attached, the components are locked to form a single structure, thus preventing them from getting loose or breaking when in use, thus making the assembly fully available for the attachment of the most diverse products in general. Therefore, the product can be easily used without worries of any nature as regarding its durability and safety.

As its structures are made of plastic or metallic material of high resistance or similar material with equal or higher lightness and strength, the drilling and anchoring device for diverse applications and the components thereof, are rust-proof and waterproof, are washable and possess high resistance to various chemical products, as well as a high level of durability and strength, provide greater safety and, when routinely used, do not present any risks of fatigue of its structure and to the users in general.

For all of the above, this is a piece of equipment that will be well received by the companies working with the direct attachment of products in general to the most diverse types of soils, since the present drilling and anchoring device for diverse applications presents several advantages, such as: great safety, reliability and agility in its applications and uses; great strength and durability, as well as a low or no wear of the assembly as a whole; greater comfort, facility and safety to the users; great efficiency and performance in its application due to its general conception; fully accessible costs, which provides an optimum cost/benefit ratio; practical and safe use by any users, regardless of the characteristics thereof; great versatility and flexibility provided by the high mobility and different configurations of the assembly as a whole; practical and safe in the drilling and anchoring operations; extremely compact, as well as possessing a low weight and dimensions in general; reduced number of components; reduced, practical and economic general maintenance; small effort required in a fast and clean application; high power of attachment to soils; no need of previous excavation on soils; and the certainty of always having a product that fully meets the ideal safety, strength and durability conditions required for its application by users in general.

For all of the above, the present drilling and anchoring device can be used for diverse applications, as a fully versatile, efficient, practical and safe means for manually or mechanically attach several products directly to the most diverse types of soils and by any users, regardless of their needs, so as to enable a proper support thereof, being easily installed and handled, as well as having excellent general characteristics; the sizes, dimensions and quantities may vary, depending on the use needs.

The invention claimed is:

1. A Drilling and Anchoring Device for Diverse Applications comprising: a drilling and anchoring device (1), made of plastic or metallic material of high resistance or similar material of equal or higher lightness and strength and possessing a properly integrated and attached main supporting body (2) having a general turbular shape and a tip (2A) of cylindrical shape symmetrically arranged at the lower end as an extension; a lower penetration device (3) having a general conical pointed shape, symmetrically arranged and fitted from its upper end into the lower end of the main supporting body (2), as a lower extension thereof, and having an upper coupling tip threaded on its external surface and centrally arranged on the upper end to attach the lower penetration device (3) to the main supporting body (2) by superposition, two plates (3A) having general trapezoidal shapes with a small concavity on its length, symmetrically and perpendicularly arranged on the outer surface of the lower penetration device (3), two blades (3B) having general semicircular shapes symmetrically and perpendicularly arranged around part of the outer surface of the lower penetration device (3), with a slight inclination in relation to the axis and below the two plates (3A), forming a helical element, and a tip (3C) having a general pointed shape centrally arranged and attached to the lower end as a lower extension thereof; and a central rotating device having a general tubular shape threaded on its lower end inner surface which, during its use, is arranged lengthwise inside the main supporting body (2) and is attached by its lower end to the upper end of the lower penetration device (3).

2. A Drilling and Anchoring Device for Diverse Applications as in claim 1 further comprising, incorporating a proprietary and modular structure that integrates in a single structure the main supporting body (2) and the lower penetration device (3) by its lower and upper ends, respectively, with the lower penetration device (3) forming an extension of the main supporting body (2).

3. A Drilling and Anchoring Device for Diverse Applications as in claim 1, further comprising an upper fitting device perpendicularly arranged and fitted into the upper end of the main supporting body (2), as an extension thereof.

4. A Drilling and Anchoring Device for Diverse Application as in claim 2, further comprising an upper fitting device perpendicularly arranged and fitted into the upper end of the main supporting body (2), as an extension thereof.

* * * * *